US008020951B2

(12) United States Patent
Twellmann

(10) Patent No.: US 8,020,951 B2
(45) Date of Patent: Sep. 20, 2011

(54) ROTATION AND PULL-OUT FITTING FOR A CORNER CABINET

(75) Inventor: Günter Twellmann, Spenge (DE)

(73) Assignee: Ninkaplast GmbH, Bad Salzuflen (DE)

( * ) Notice: Subject to any disclaimer, the term of this patent is extended or adjusted under 35 U.S.C. 154(b) by 483 days.

(21) Appl. No.: 11/741,807

(22) Filed: Apr. 30, 2007

(65) Prior Publication Data

US 2007/0262682 A1 Nov. 15, 2007

(30) Foreign Application Priority Data

May 15, 2006 (DE) ..... 20 2006 007 853 U
Nov. 18, 2006 (DE) ..... 20 2006 017 567 U

(51) Int. Cl.
*A47B 81/00* (2006.01)

(52) U.S. Cl. ..... 312/238; 312/302

(58) Field of Classification Search ..... 312/238, 312/322, 323, 349, 350, 294, 305, 307, 282, 312/24, 25, 27, 28, 30, 302, 310, 283
See application file for complete search history.

(56) References Cited

U.S. PATENT DOCUMENTS

| | | | | |
|---|---|---|---|---|
| 542,277 | A * | 7/1895 | Pauly, Sr. | 312/302 |
| 719,625 | A * | 2/1903 | Throm | 312/27 |
| 851,659 | A * | 4/1907 | Gaaikema | 312/28 |
| 1,098,482 | A * | 6/1914 | Combes | 312/329 |
| 2,580,032 | A * | 12/1951 | Lindelof | 108/93 |
| 2,650,871 | A * | 9/1953 | Holderegger | 312/322 |
| 3,550,982 | A * | 12/1970 | Zaidan | 312/302 |
| 4,124,262 | A * | 11/1978 | Schill | 312/305 |
| 4,582,372 | A * | 4/1986 | Cooper | 312/322 |
| 4,639,051 | A * | 1/1987 | DeBruyn | 312/275 |
| 4,738,495 | A * | 4/1988 | Mitts | 312/305 |
| 4,959,582 | A * | 9/1990 | Meyer et al. | 312/307 |
| 5,152,592 | A * | 10/1992 | Krayer | 312/238 |
| 6,206,495 | B1 * | 3/2001 | Peterson | 312/283 |
| 7,147,445 | B2 * | 12/2006 | Krayer | 418/150 |
| 2002/0117943 | A1 * | 8/2002 | Gerkey et al. | 312/238 |
| 2006/0012273 | A1 * | 1/2006 | Kreyenkamp | 312/238 |

FOREIGN PATENT DOCUMENTS

| | | |
|---|---|---|
| DE | 8624899 U1 | 11/1986 |
| DE | 3730832 A1 | 3/1988 |
| DE | 202004011200 U1 | 12/2005 |

* cited by examiner

*Primary Examiner* — James O Hansen

(74) *Attorney, Agent, or Firm* — Richard M. Goldberg

(57) ABSTRACT

Rotation and pull-out fitting for a shelf in a corner cabinet, includes a carrier supported in the corner cabinet to be rotatable about a vertical axis, and a pull-out guide on which the shelf is displaceable relative to the carrier, the pull-out guide being mounted on a intermediate carrier that is itself rotatable relative to the carrier about an axis that is parallel with the axis of rotation of the carrier but offset therefrom.

7 Claims, 8 Drawing Sheets

ROTATION AND PULL-OUT FITTING FOR A CORNER CABINET

The invention relates to a rotation and pull-out fitting for a shelf in a corner cabinet, comprising a carrier that is supported in the corner cabinet to be pivotable about a vertical axis, and a pull-out guide on which the shelf is displaceable relative to the carrier.

DE 20 2004 011 200 U1 discloses a kitchen corner cabinet wherein the shelf is supported on two swivel arms that are pivotable about vertical axes such that, in order for the objects deposited on the shelf to be more readily accessible, the shelf can be moved out of the door opening of the corner cabinet in a smooth movement that reminds of a double bend. In this case, however, the footprint of the shelf must have a shape with which the internal space of the cabinet is only poorly exploited. Moreover, this footprint is asymmetrical, so that different shelf versions need to be manufactured and delivered for left and right corner cabinets.

DE 86 24 899 U1 discloses a rotation and pull-out fitting of the type indicated above, wherein the shelf is at first pivoted out of the door opening by means of the carrier and can then further be drawn out of the door opening relative to the carrier. This has the advantage that, even in the drawn-out position, the shelf remains essentially within the space that is present in front of the door opening and must be cleared anyway in order to open the door of the corner cabinet. Consequently, the user, when drawing-out the shelf, may stand aside of the corner cabinet and may closely approach a countertop that is present above the corner cabinet, so that he can easily take up the objects that have been placed on the shelves. Moreover, it is ergonomically favorable that the pivotal movement is followed only by a linear translational movement but not by another pivotal movement in opposite direction.

In this fitting, the pull-out movement of the shelf is forcibly coupled with the pivotal movement of the carrier, so that the shelf moves always on a well-defined trajectory. However, this fitting has also some limitations in view of the shape of the footprint of the shelf, so that the storage area provided by the shelf does not optimally exploit the internal space of the corner cabinet.

It is an object of the invention to improve a rotation and pull-out fitting of the type mentioned above such that the available space is better exploited and a smooth pivotal and linear movement is achieved.

According to the invention, this object is achieved by the feature that the pull-out guide is mounted on an intermediate carrier which is itself rotatable relative to the carrier about an axis that is parallel with the axis of rotation of the carrier but offset therefrom.

Thus, the shelf has three degrees of freedom of movement, i.e. two degrees of freedom in rotation, about the axis of the carrier, which axis is fixed relative to the body of the cabinet, and about the offset axis of the intermediate carrier, and one degree of freedom in translation. The movements in these three degrees of freedom can be combined and superposed in such a manner that, as a whole, a smoother course of movement and hence an easier handling of the shelf is achieved. In addition, thanks to the pivotal movement of the intermediate carrier relative to the carrier, the shelf is displaced such that it can have a larger footprint so as to better exploit the internal space of the cabinet and nevertheless fits through the relatively narrow door opening. As another advantage, the intermediate carrier, when pivoted relative to the carrier, is moved further out of the door opening, so that it can better support the shelf when the latter has been drawn out to an extreme cantilever position and is therefore subject to a high tilting moment due to the weight of the objects placed thereon. It has also been found advantageous that the footprint of the shelf can have a symmetrical shape, so that it is not necessary to distinguish between left and right corner cabinets.

Useful details of the invention are indicated in the dependent claims.

Embodiment examples will be described below in conjunction with the drawings, wherein.

Figure 2:
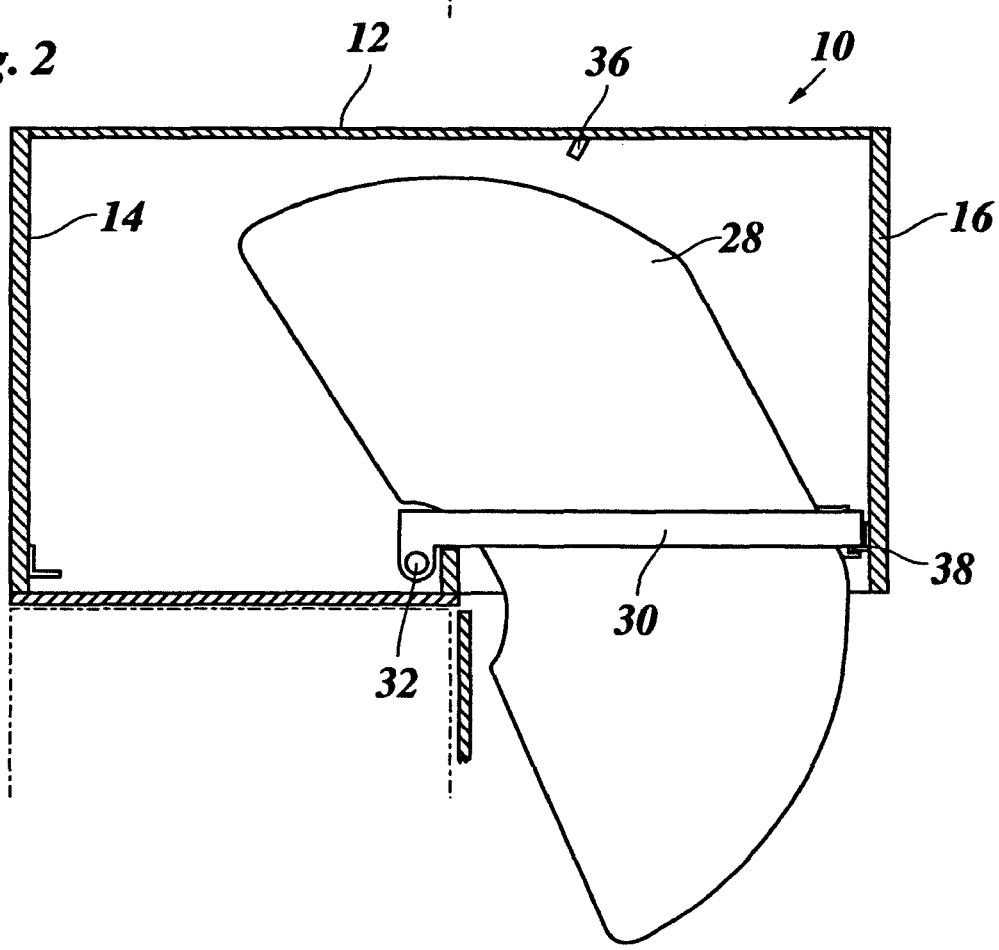
FIG. 2 shows the corner cabinet with the shelf partly being pivoted outwardly.
Figure 3:
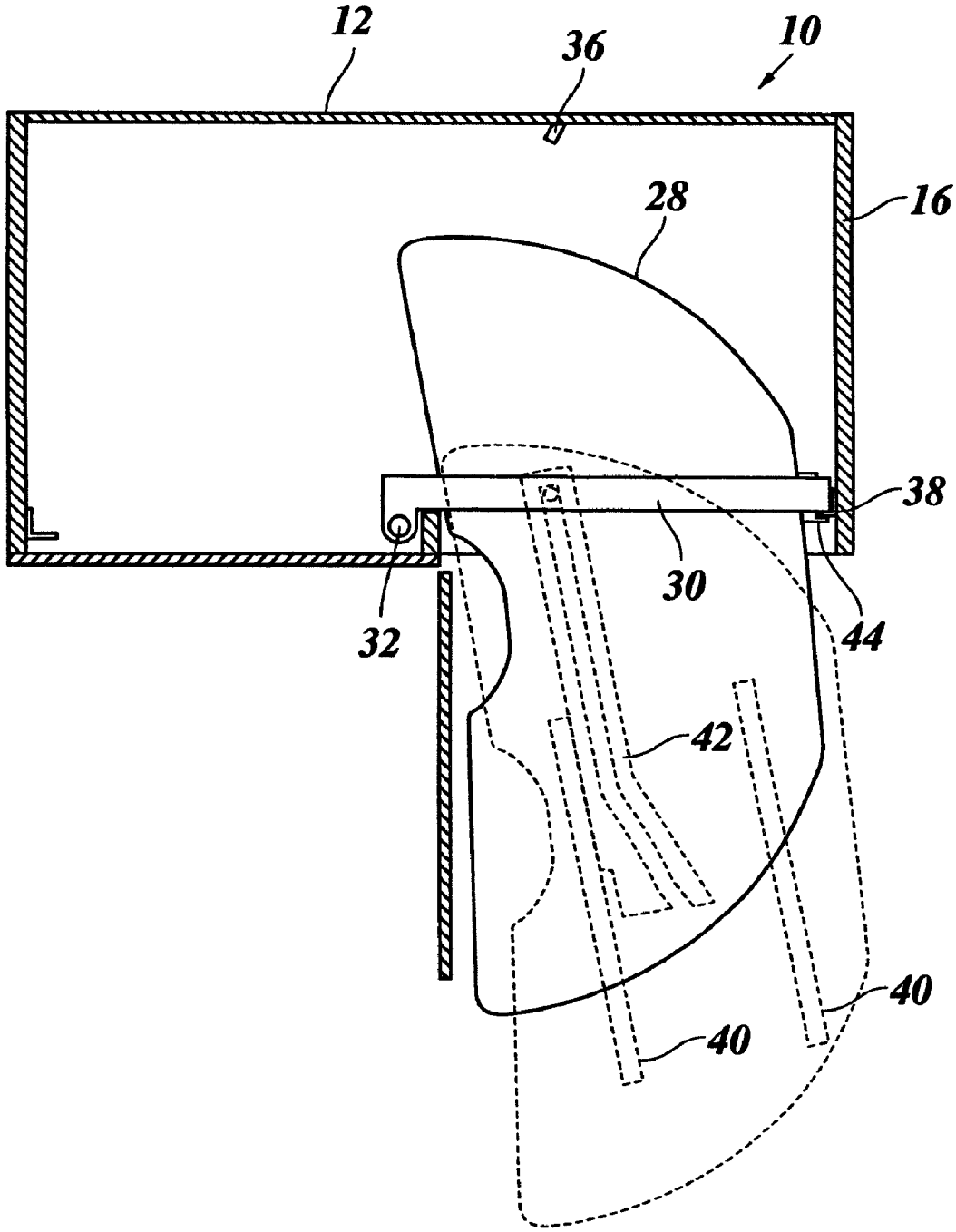
Figure 4:
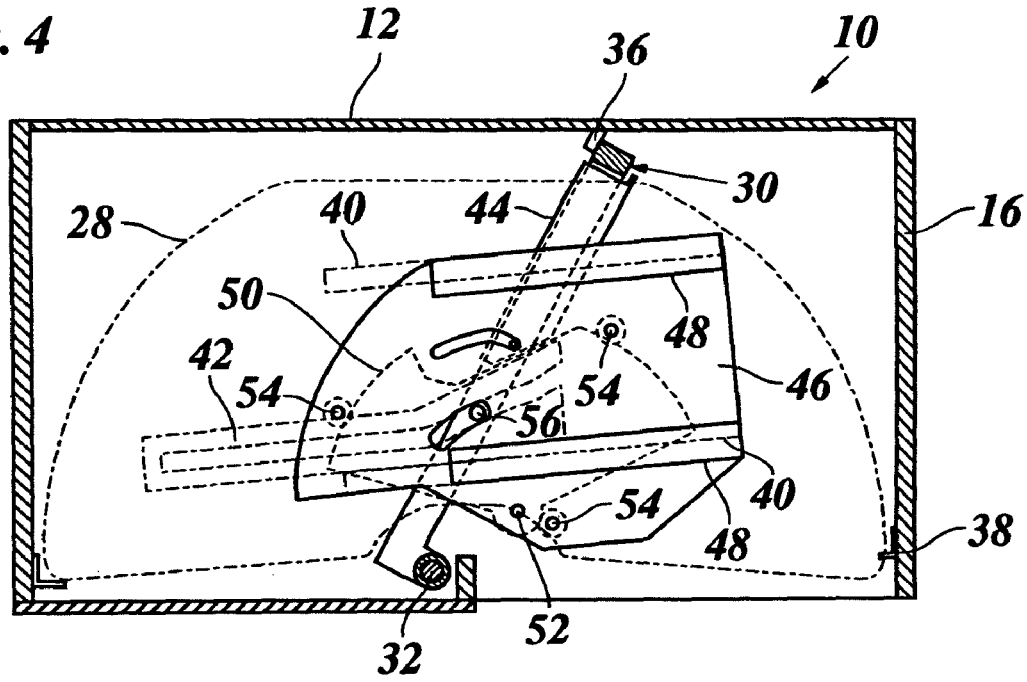
Figure 5:
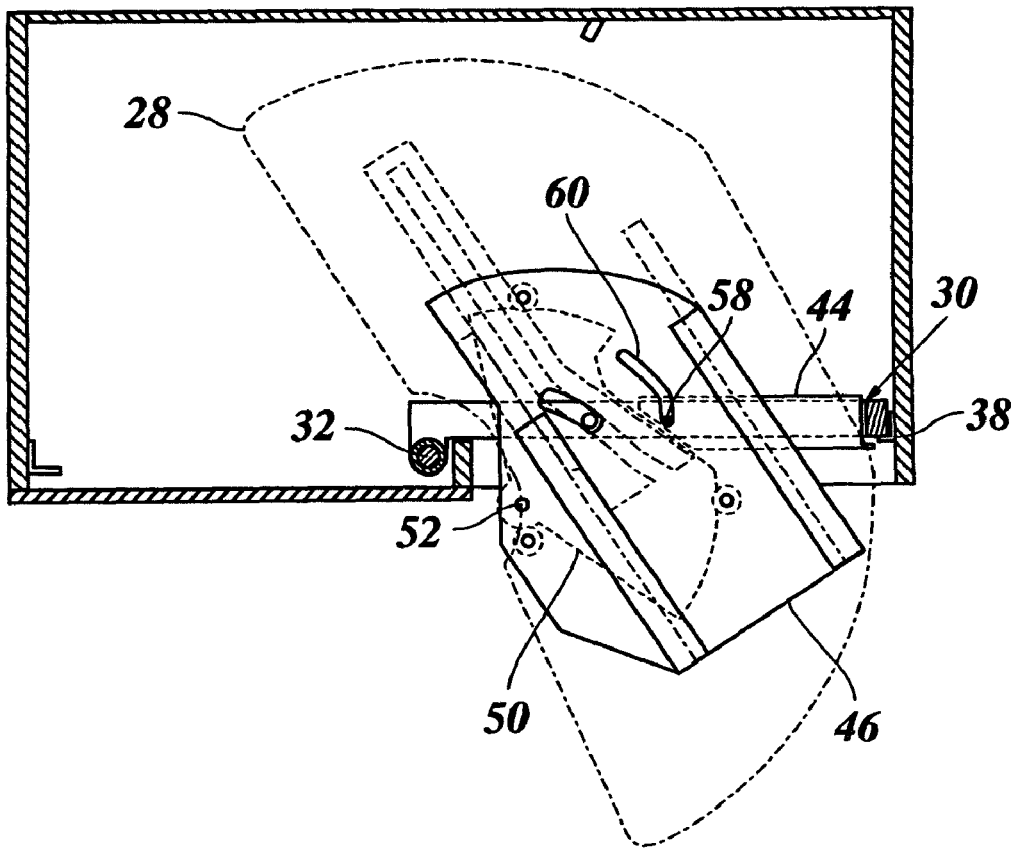
Figure 6:
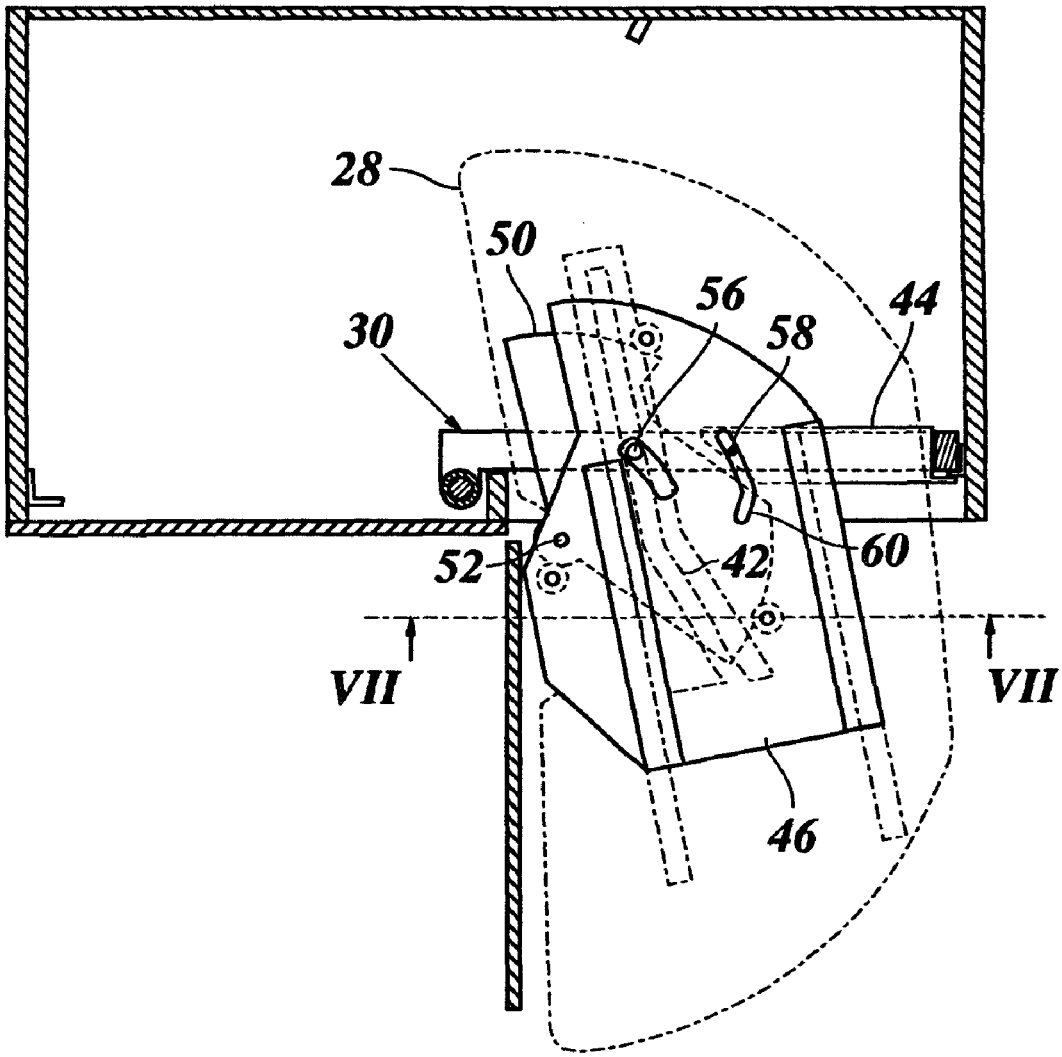
Figure 7:
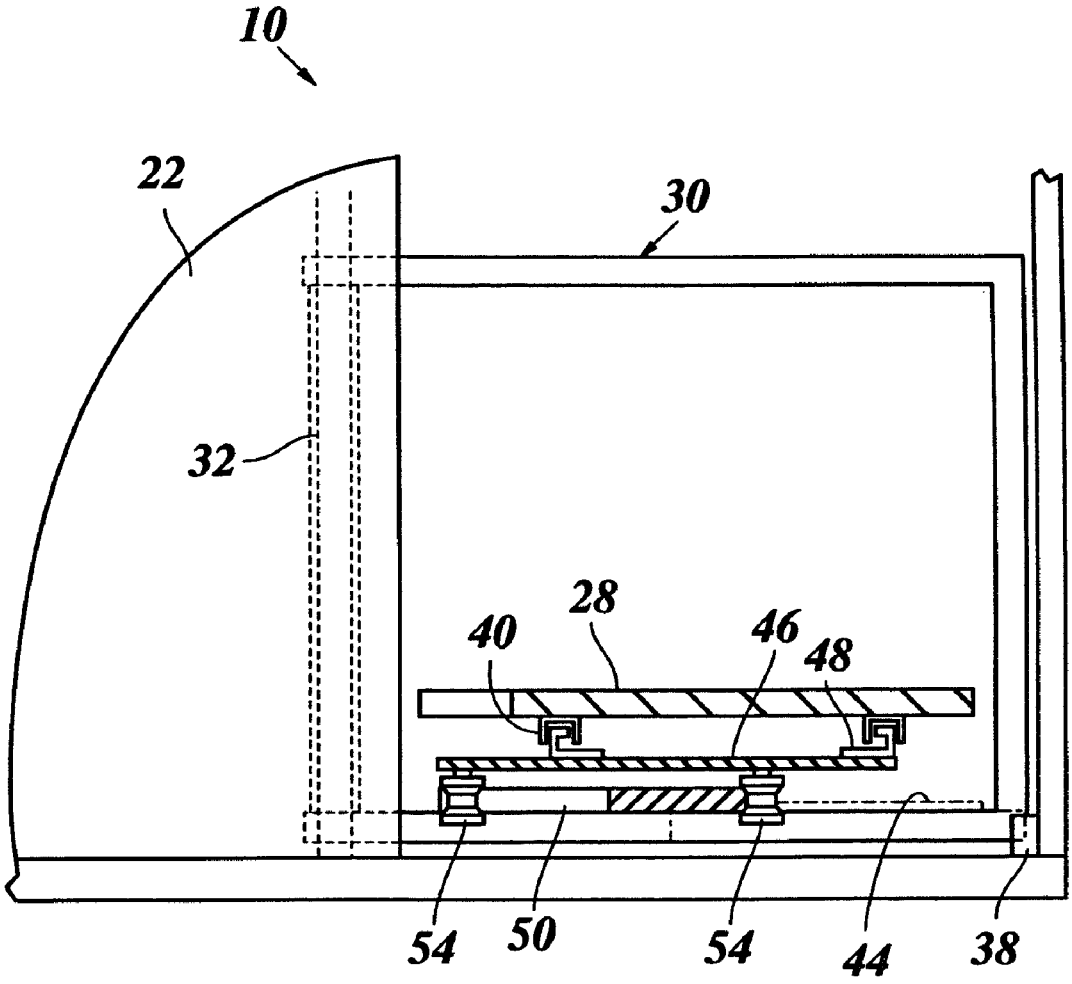
Figure 8:
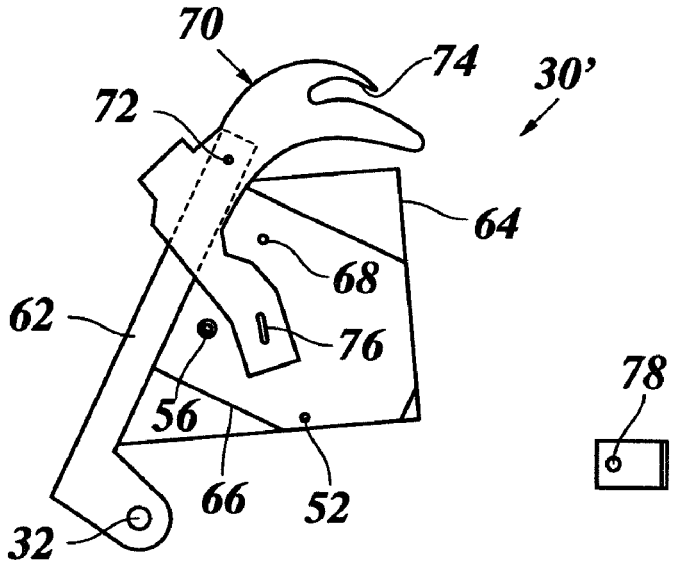
Figure 9:
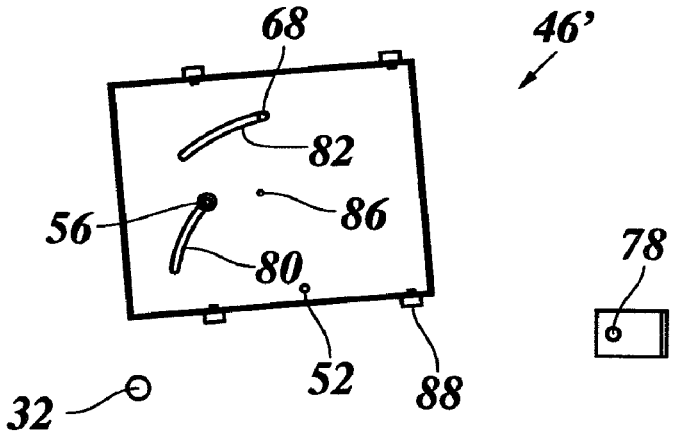
Figure 10:
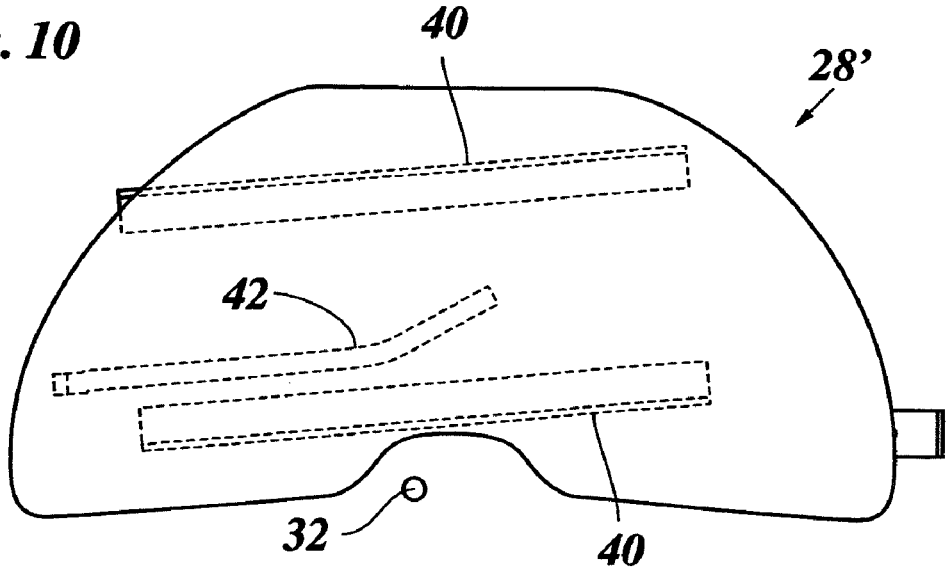
Figure 11:
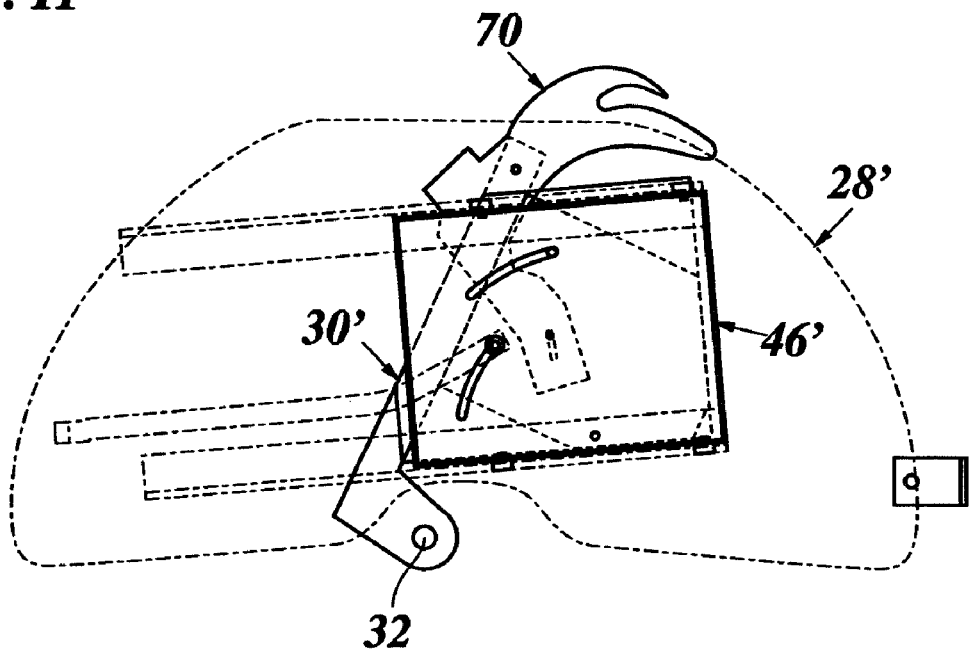
Figure 12:
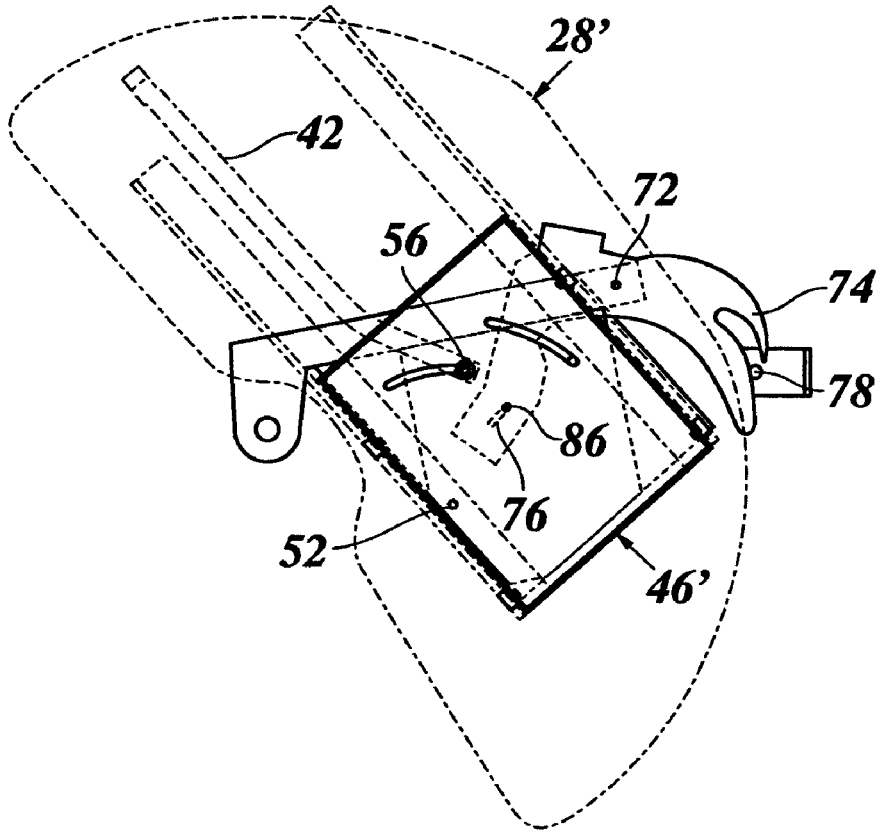
Figure 13:
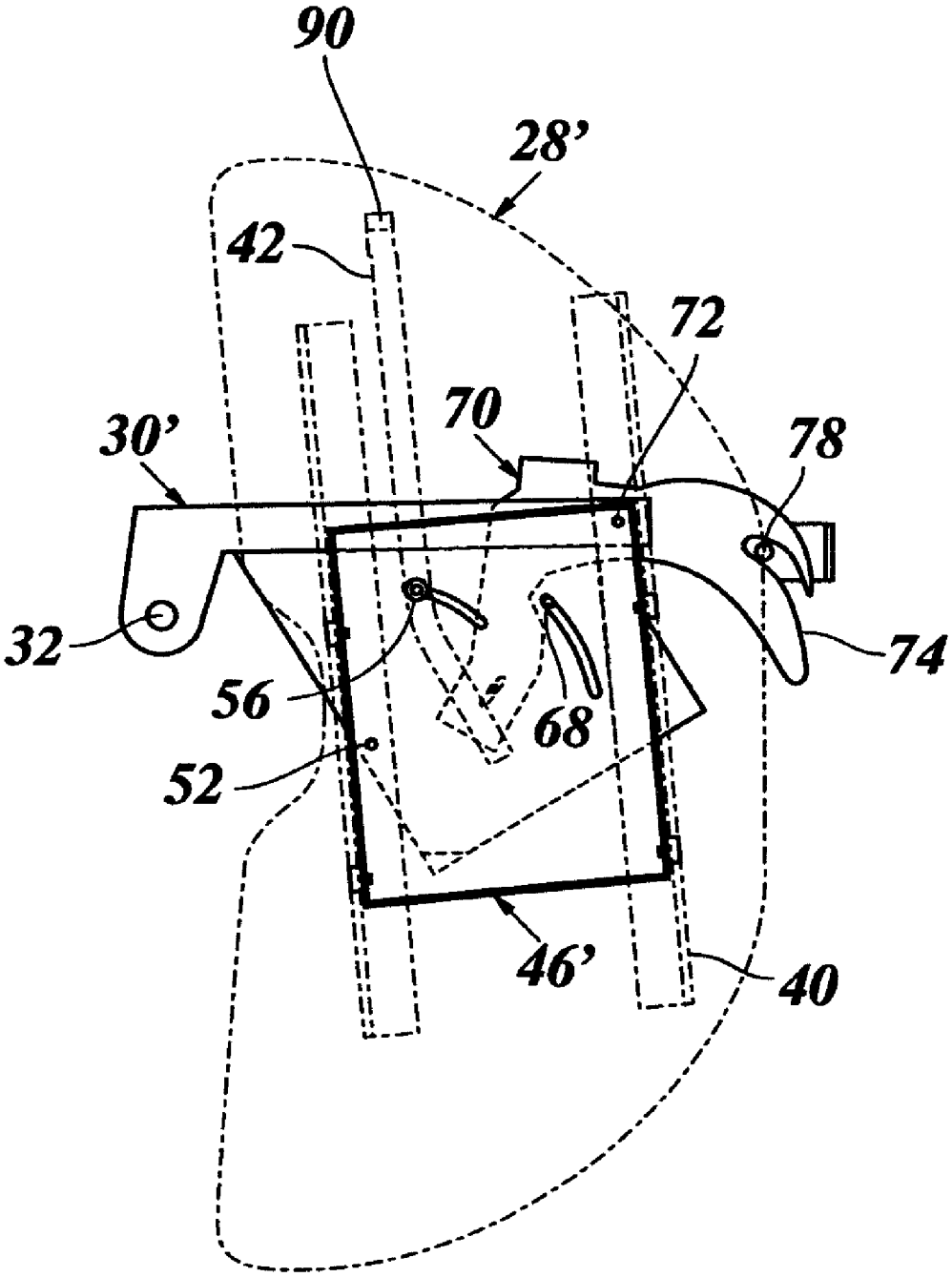

FIG. 3 the corner cabinet with the shelf further pivoted to the outside and with a pull-out guide, indicated in phantom lines, for a subsequent pull-out movement of the shelf;

FIG. 4 the corner cabinet in the same condition as in FIG. 1, but with the shelf being shown only in phantom lines, so that parts of the fitting situated below the shelf are visible;

FIG. 5 the fitting in the position partly pivoted to the outside, as in FIG. 2;

FIG. 6 the fitting in the position further pivoted to the outside, as in FIG. 3;

FIG. 7 a schematic front view of a part of the corner cabinet, with the shelf being shown in a section along the line VII-VII in FIG. 6;

FIGS. 8-10 essential parts of a fitting according to another embodiment example; and FIGS. 11-13 sketches for explaining the operation of the fitting according to FIGS. 8 to 10.

Figure 1:
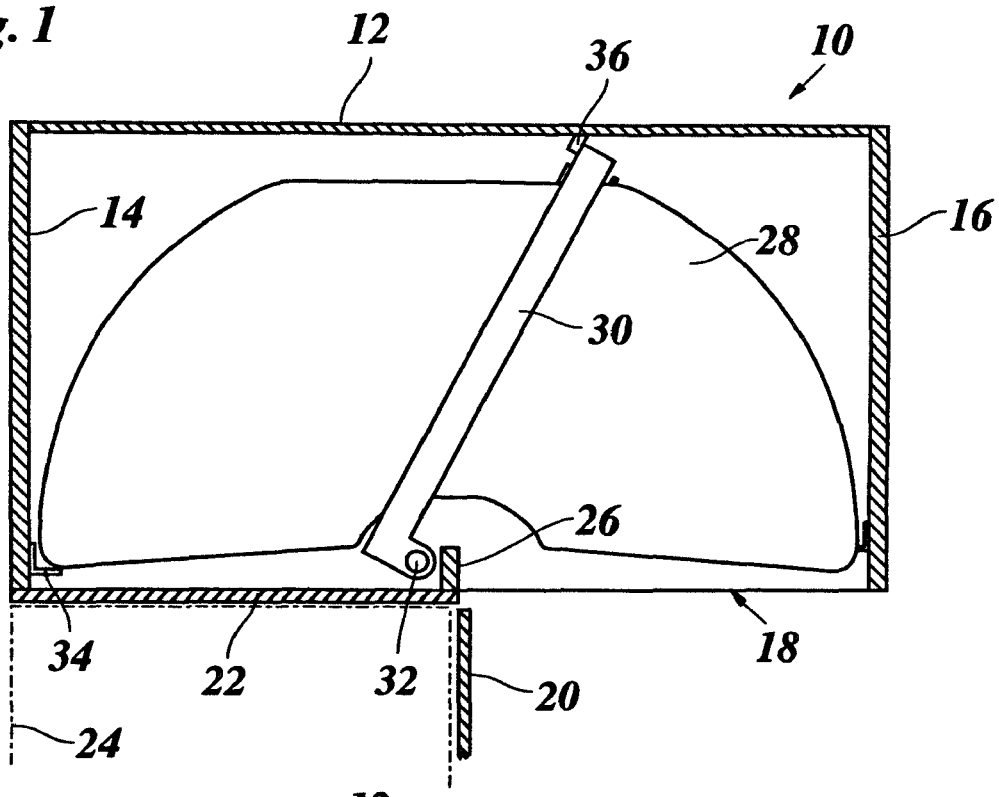
FIG. 1 is a schematic horizontal cross-sectional view of a corner cabinet having a shelf and a rotation and pull-out fitting according to the invention.

FIG. 1 illustrates a corner cabinet 10 having a rear wall 12, left and right side walls 14, 16 and, in the right half, a door opening 18. The associated door 20 has been shown only in part and in an open position. The left part of the corner cabinet is closed-off by a front wall 22 and is barred by another kitchen cabinet 24 that has only been shown in phantom lines. The door opening 18 is limited on one side by a center post 26 disposed adjacent to the front wall 22.

The corner cabinet 10 accommodates a shelf 28 which has a symmetrical, approximately semi-circular footprint and largely fills the internal footprint of the corner cabinet. The shelf 28 is supported on a carrier 30 that has the shape of a closed rectangular frame of which only the upper leg is visible in FIG. 1. This carrier is pivotable about an axis 32 that is fixedly arranged in the body of the corner cabinet adjacent to the center post 26. To that end, one of the vertical legs of the carrier is shaped as a sleeve that surrounds the axis 32. The left corner of the shelf 28 abuts at a stop 34 that is mounted to the side wall 14 and may also be configured as a damper, as is known per-se. In FIG. 1, the free end of the carrier 30 engages a stop 36 that is mounted to the rear wall 12 and, preferably, is also damped.

In order to move the shelf 28 out of the door opening 18, the shelf is gripped with a hand at its edge exposed in the door opening and is drawn-out. By means of a fitting mechanism that will be described in detail hereinbelow, the shelf 28 is coupled to the carrier 30 in such a manner that the shelf 28 and the carrier 30 will at first pivot as a unit about the axis 32, as has been shown in FIG. 2. This common pivotal movement continues until the carrier 30 abuts with its free end at a stop 38 that is secured at the right side wall 16.

Then, the shelf 28, without the carrier 30, continues to pivot in the same rotation direction into the position that has been shown in solid lines in FIG. 3, and in the course of this movement, it is also slightly drawn out of the door opening already relative to the carrier 30. Due to the pivotal movement, the shelf 28 reaches a position in which it is oriented almost at right angles to the carrier 30 and hence also essentially at right angles relative to the door opening. This permits to dimension the footprint of the shelf 28 such that it practically exhausts the entire width of the door opening.

Secured to the bottom side of the shelf 28 are a pair of pull-out rails 40 and a guide jig 42 which co-operate with an intermediate carrier that has not been shown in FIG. 3 and which permit to draw-out the shelf 28 into the position that has been shown in phantom lines in FIG. 3. In this position, the shelf is located almost completely outside of the corner cabinet, so that the objects placed thereon are readily accessible.

On the free end of its lower leg (hidden in FIG. 3), the carrier 30 has a locking member 44 which, as is shown in FIG. 3, locks at the stop 38, so that the carrier 30 cannot be pivoted when the shelf 28 is pushed back from the position shown in phantom lines into the position shown in solid lines. In this way, it is assured that the shelf will not collide with the edges of the door opening in the completely drawn-out position nor later during the thrust-in movement.

Moreover, the course of the pull-out rails 40 in FIG. 3 indicates that the pull-out direction of the shelf 28 is not orthogonal to the plane of the door opening but forms a certain angle therewith, so that, in the course of the pull-out movement, the shelf moves further away from the center post 26 and the door hinges mounted thereto. This permits to give the shelf 28 such a shape that it does not form an exact semi-circle but rather a circular segment having a peripheral angle of significantly more than 180°, with the result that the storage area is enlarged.

In FIG. 4, the shelf 28 has only be shown in dashed lines, so that an intermediate carrier 46 that is disposed below the shelf becomes visible. Mounted on the intermediate carrier are two guide rails 48 which, together with the pull-out rails 40 form the pull-out guide for the shelf 28.

The carrier 30 and the axis 32 have been shown in section in FIG. 4, so that, now, the lower leg of the bow-shaped carrier 30 is visible, on which the locking member 44 is slidably disposed. This lower leg of the carrier 30 has mounted thereon a rigid guide plate 50 which, in FIG. 4, is located entirely below the plate-shaped intermediate carrier 46. The intermediate carrier 46 is pivotable relative to the guide plate 50 about an axis 52 that extends in parallel with the axis 32 of the carrier 30 but is offset therefrom. Moreover, the intermediate carrier 46 is supported on the guide plate 50 by three rollers 54 which are rotatably supported at the bottom side of the intermediate carrier and straddle the edge of the guide plate 50 to roll therealong. The edge portions of the guide plate 50 at which the rollers 54 roll along extend concentrically with the axis 52.

From the lower leg of the carrier 30, or rather from the guide plate 50 fixed thereon, a pin 56 projects upwardly and extends through an arcuate slot of the intermediate carrier 46 and then engages with its top end into the guide jig 42 at the bottom side of the shelf 28.

FIG. 5 shows the shelf 28 and the carrier 30 in the position in which the carrier 30 abuts the stop 38, as in FIG. 2. A pin 58 projecting upwardly from the locking member 44 is guided in a groove 60 of the intermediate carrier 46. As a result, the locking member 44 is held, in FIG. 5, in a position in which it can move past the stop 38. The carrier 30 itself, however, is caught by the stop 38.

When, in the situation shown in FIG. 5, the carrier 30 abuts at the stop 38, the shelf 28, due to its mass of inertia, will have a tendency to continue its movement about the axis 32. Moreover, the user will continue to drag at the front edge of the shelf 28. Since, however, the carrier 30 is now immobilized, the result is on the one hand a pivotal movement of the intermediate carrier 46 about the axis 52 and on the other hand a translational movement of the shelf 28 relative to the intermediate carrier 46 and along the pull-out guide.

In this way, the condition shown in FIG. 6 will be reached. Due to the translational movement of the shelf 28 along the pull-out guide, the pin 56 moves at first through a portion of the guide jig 42 that is inclined relative to the pull-out guide. Consequently, the pin 56 exerts a torque acting in the clock sense in FIG. 6 onto the shelf 28. By the guide rails and pull-out rails engaging one another, this torque is also transmitted onto the intermediate carrier 46 which will therefore pivot about the axis 52. Thus, during this phase, the pull-out movement and the pivotal movement are forcibly coupled with one another.

Due to the pivotal movement of the intermediate carrier 46, the pin 56 moves towards the opposite end of the associated slot in the intermediate carrier.

Likewise, the pin 58 moves through the slot 60 and is at the same time shifted to the right while it passes through an angled end of this slot. In this way, the locking member 44 is brought into its locking position. The pin 58 moves further in a portion of the slot 60 that extends concentrically with the axis 52.

The shelf 28 can now be drawn-out into the position shown in FIG. 3. The pull-out movement is stopped by the pin 56 abutting at the closed end of the guide jig 42.

When the shelf 28 is pushed-in again, the angled portion of the guide jig 42 runs onto the pin 56 and thereby experiences a torque in counter-clock sense, so that the shelf 28 and the intermediate carrier 46 are pivoted back into the position shown in FIG. 5. In the final phase of this pivotal movement, the slot 60 causes the locking member 44 to unlock, so that also the carrier 30 is pivoted again in the counter-clock sense, until it reaches again the position shown in FIGS. 1 and 4.

Optionally, the fitting can be equipped with an automatic draw-in mechanism (not shown) which, when the shelf 28 is pushed back from the position shown in FIG. 6, causes, after overcoming a dead center, the automatic withdrawal of the shelf and then the pivotal movement of the intermediate carrier 46 and finally the carrier 30. Such automatic draw-in mechanisms for drawers for furniture are generally known and can analogously be utilized here for withdrawing the shelf 28. The carrier 30 may be elastically biased into the position shown in FIG. 1, so that it will automatically return in this position as soon as it is set free by the locking member 44.

FIG. 7 shows the corner cabinet and the rotation and pull-out fitting (in the condition according to FIG. 6) in a front view. What is to be seen here is in particular the bow-like shape of the carrier 18 which permits to transmit the weight force into the axis 32 even when the shelf 28 is subject to a high load. The height of the upper leg has been selected such that the objects placed on the shelf 28 can pass through underneath that leg.

Further, it can be seen here how the double-cone rollers 54 straddle the edge of the guide plate 50 and support the intermediate carrier 46 which in turn supports the shelf 28 via the guide rails 48 and the pull-out rails 40 which are preferably provided with ball bearings (not shown). As is shown in FIG. 6, two of the rollers 54 are located distinctly in front of the door opening, so that they safely support the cantilevered shelf, whereas the rear roller prevents the rear end of the shelf from tilting upwards.

In a modified embodiment which has not been shown, the guide plate 50 may be replaced by a frame structure which carries the rollers 54 which would then straddle a suitably shaped edge of the intermediate carrier 46.

By means of fittings of the type described herein, several shelves 28 can be arranged in the corner cabinet one above the other. Preferably, each shelf has its own carrier 30, and these carriers are pivotable about the axis 32 independently from one another.

Whereas, in the present embodiment, there is only an enforced coupling between the pull-out movement of the shelf and the pivotal movement of the intermediate carrier, it is possible in another embodiment to provide an enforced coupling between the pull-out movement and/or the pivotal movement of the intermediate carrier with the pivotal movement of the carrier 30, so that respective pairs of two motion phases or even all three motion phases overlap with one another. In this way, the transitions between the motion phases can be made even smoother.

FIGS. 8 to 13 illustrate an embodiment example which differs from the example that has been described above in particular in view of the support for the intermediate carrier, the construction of the stop and locking mechanisms, and the type of enforced coupling.

First, FIG. 8 shows a top plan view of a carrier 30' which corresponds to the previously described carrier 30 as far as its function is concerned. However, this carrier 30' is not shaped as an upright frame, but is mainly formed by a horizontal arm 62 and a rack 64 laterally projecting therefrom and having a shape of a shallow box that is internally reinforced by an approximately diagonally extending inverted U-shaped strengthening profile 66. An angled end of the arm 62 is rotatably held at the axis 32. The rack 64 has, in addition to the axis 52 for the intermediate carrier and the pin 56 engaging into the guide jig of the shelf, a support and guide pin 68 for the intermediate carrier.

Mounted on the carrier 30' is a plate-like locking member 70 that has the shape of an annular lever and is pivotable about an axis 72 relative to the carrier. One end of the locking member 70 forms the beak 74, and an elongated hole 76 is formed at the other end. The beak 74 co-operates with an abutment pin 78 that is secured to an internal face of the side wall of the cabinet body that has not been shown here.

FIG. 9 shows a corresponding intermediate carrier 46' having the form of a shallow, upwardly open box with a rectangular contour. The intermediate carrier is pivotable relative to the carrier 30' about the axis 52 and is further supported on the bottom side by enlarged base portions of the pin 56 and the support and guide pin 68. Optionally, additional slide bearings (not shown) for supporting the intermediate carrier may be provided on the carrier. The pins 56 and 68 engage into arcuate guide slots 80 and 82 formed in the bottom of the intermediate carrier 46'. In addition, a pin 86 projects from the bottom side of the intermediate carrier and engages into the elongated hole 76 of the locking member 70. Moreover, the intermediate carrier 46' is formed at its longitudinal sides with two pairs of rollers 88 that run in the pull-out rails 40 of the shelf and support the same.

FIG. 10 shows the corresponding shelf 28' having the pull-out rails 40 and the guide jig 42 for the pin 56 secured to the bottom side thereof. The shelf 28' may for example be an injection molded plastic member and the guide jig 42 may then be formed directly in the bottom side of the shelf, so that the height of the fitting is reduced.

The operation of this fitting will now be explained in conjunction with FIGS. 11 to 13.

FIG. 11 shows the shelf 28' in the position in which it is entirely accommodated in the corner cabinet. Then, the carrier 30', the intermediate carrier 46' and the shelf 28' are again rotated as one unit clock-wise about the axis 32 until they reach the position shown in FIG. 12 in which the beak 74 of the locking member hooks-in at the abutment pin 78. Then, in the further course of the pivotal movement, the abutment pin 78 enters into the beak 74 and pivots the locking member 70 relative to the carrier 30' in counter-clock sense about the axis 72. In this process, the pin 86 engaging in the elongated hole 76 is entrained by the intermediate carrier 46' and pivoted clock-wise about the axis 52. In this phase, the pull-out movement of the shelf 28' along the pull-out rails 40 commences, with the pin 56 being moved through the angled branch of the guide jig 42. The pin 56 then exerts via the guide jig 42 a torque acting in clock-sense onto the shelf 28', whereby the pivotal movement of the intermediate carrier 46 and the shelf 28' about the axis 52 is assisted.

FIG. 13 shows the condition in which the abutment pin 78 engages the bottom of the beak 74. The pivotal movement of the locking member 70 about the axis 72 is terminated by the edge contour of the locking member abutting at the support and guide pin 68. Thus, the locking member 70 caught at the abutment pin 78 inhibits also a further pivotal movement of the carrier 30'. Moreover, the pins 56 and 68 have reached the opposite end of the arcuate slots in the intermediate carrier 46', so that the intermediate carrier cannot be pivoted further, neither. The shelf 28' may now be pulled-out further in a rectangular movement along the pull-out rails 40 until it reaches the fully drawn-out position. During this process, the pin 56 moves through the straight branch of the guide jig 42.

When, in this condition, a torque acting in counter-clock sense is exerted onto the shelf 28', the beak 74 prevents the carrier 30' from rotating about the axis 32. In order to be freed from the abutment pin 78, the locking member 70 would at first have to pivot clock-wise about the axis 72 and would simultaneously have to rotate, via the pin engaging into the elongated hole 76, the intermediate carrier 46' and hence also the shelf 28' relative to the carrier 30' in counter-clock sense about the axis 52. This, however, is not possible as long as the pin 56 is accommodated in the straight branch of the guide jig 42 and prevents the shelf 28 from rotating relative to the carrier 30. Consequently, the shelf 28' and the carrier 30' are locked in their angular position in the drawn-out state. Only when the shelf is pushed in again, the pin 56 runs onto the inclined branch of the guide jig 42 and thereby causes the shelf 28' and the intermediate carrier 46' pivot in a counter-clock sense about the axis 52. As a result, the locking member 70 is returned into the position shown in FIG. 12, so that the beak 74 releases the abutment pin 78. The retreat movement of the abutment pin 78 out of the beak 74 results from a superposition of the pivotal movement of the locking member 70 with the pivotal movement of the carrier 30' that sets in simultaneously.

Thus, by means of the mechanism that has been described above, an automatic locking and unlocking of the shelf 28' and the carrier 30' is achieved, and at the same time it is assured that the movement of the shelf 28' transits gradually and smoothly from the rotation into the translation (during opening) and from the translation into the rotation (during closing).

The pull-out movement of the shelf 28' along the pull-out rails 40 is limited by a stop 90 formed at the end of the guide jig 42, which stop engages the side wall of the intermediate carrier 46'. This stop 90 however, is formed by an elastic catch that may be pressed back into the interior of the shelf 28', so that the shelf can be drawn out further until, finally, the rollers 88 exit from the pull-out rails 40 and the shelf can then been drawn-off upwardly. In this way, the shelf 28' can easily and conveniently be released from the intermediate carrier 46'.

The stop 90 further has an inclined ramp surface which causes the stop to snap-in automatically when the shelf is again pushed with its pull-out rails 40 onto the rollers 88.

The invention claimed is:

1. Rotation and pull-out fitting for a shelf in a corner cabinet, comprising:

a carrier adapted to be supported in the corner cabinet to be rotatable about a vertical axis, an intermediate carrier that is itself rotatable relative to the carrier about an axis that is parallel with the axis of rotation of the carrier but offset therefrom, and a pull-out guide which is mounted on the intermediate carrier and on which the shelf is slidably displaceable relative to the intermediate carrier in a substantially linear direction, and a first element formed at the shelf and a second element formed at the carrier, with the first and second elements engaging each other to force pull-out movement of the shelf relative to the intermediate carrier in said substantially linear direction, in an initial phase of that movement, to be coupled to a concurrent pivotal movement of the intermediate carrier relative to the carrier and such that pull-out movement of the shelf relative to the intermediate carrier in said substantially linear direction is adapted to continue after a predetermined pivotal movement of the intermediate carrier relative to the carrier.

2. Fitting according to claim 1, further comprising a locking member for locking the carrier at the corner cabinet, in a terminal position in which the shelf can be drawn out of the corner cabinet.

3. Fitting according to claim 1, wherein the pull-out guide comprises pull-out rails provided on the shelf, and rollers which are provided on the intermediate carrier and engage the pull-out rails of the shelf.

4. Fitting according to claim 1, wherein the shelf is detachably mounted on the intermediate carrier.

5. Corner cabinet, including the fitting according to claim 1.

6. Rotation and pull-out fitting for a shelf in a corner cabinet, comprising:

a carrier adapted to be supported in the corner cabinet to be rotatable about a vertical axis, a pull-out guide on which the shelf is displaceable relative to the carrier, an intermediate carrier that is itself rotatable relative to the carrier about an axis that is parallel with the axis of rotation of the carrier but offset therefrom, with the pull-out guide being mounted on the intermediate carrier, and a guide jig formed in a bottom side of the shelf, and wherein the carrier has an upwardly projecting pin which passes through an arcuate slot of the intermediate carrier and engages in the guide jig formed in the bottom side of the shelf.

7. Rotation and pull-out fitting for a shelf in a corner cabinet, comprising:

a carrier adapted to be supported in the corner cabinet to be rotatable about a vertical axis, a pull-out guide on which the shelf is displaceable relative to the carrier, an intermediate carrier that is itself rotatable relative to the carrier about an axis that is parallel with the axis of rotation of the carrier but offset therefrom, with the pull-out guide being mounted on the intermediate carrier, and a locking member for locking the carrier at the corner cabinet, in a terminal position in which the shelf can be drawn out of the corner cabinet, the locking member including a lever that is pivotably supported at the carrier and has one end articulated to the intermediate carrier while an opposite end forms a beak which, during the pivotal movement of the carrier about the axis thereof, is caught at a fixed abutment pin and thereby pivots the locking member relative to the carrier.

* * * * *